US009111445B1

(12) United States Patent
Pashel

(10) Patent No.: US 9,111,445 B1
(45) Date of Patent: Aug. 18, 2015

(54) WIRELESS TRAFFIC LIGHTS SYNCHRONIZER

(71) Applicant: Nicholas Pashel, Pittsburgh, PA (US)

(72) Inventor: Nicholas Pashel, Pittsburgh, PA (US)

(73) Assignee: Nicholas Pashel, Pgh, PA (US)

( * ) Notice: Subject to any disclaimer, the term of this patent is extended or adjusted under 35 U.S.C. 154(b) by 0 days.

(21) Appl. No.: 13/831,749

(22) Filed: Mar. 15, 2013

(51) Int. Cl.
*G08G 1/087* (2006.01)

(52) U.S. Cl.
CPC ..... *G08G 1/087* (2013.01)

(58) Field of Classification Search
CPC ..... G08G 1/087
USPC ..... 340/906, 907, 908, 909, 916, 924
See application file for complete search history.

(56) References Cited

U.S. PATENT DOCUMENTS

| | | | |
|---|---|---|---|
| 2,829,362 | A | 4/1958 | Terrill |
| 3,015,802 | A | 1/1962 | Newsom |
| 3,159,817 | A | 12/1964 | Hendricks et al. |
| 3,168,685 | A | 2/1965 | Beet |
| 3,247,482 | A | 4/1966 | Lesher |
| 3,867,718 | A | 2/1975 | Moe |
| 4,162,477 | A | 7/1979 | Munkberg |
| 4,401,969 | A | 8/1983 | Green et al. |
| 4,857,921 | A | 8/1989 | McBride et al. |
| 5,959,554 | A | 9/1999 | Armstrong et al. |
| 6,118,388 | A | 9/2000 | Morrison |
| 8,242,933 | B2 | 8/2012 | Pashel |
| 2006/0197683 | A1 | 9/2006 | Hammett |

OTHER PUBLICATIONS

"New LED Traffic Signals from Lights to Go", website: http://www.trafficlights.com/LEDsigs.htm#JD200/RC3; printed Mar. 11, 2009; 7 pages.

*Primary Examiner* — Toan N Pham
(74) *Attorney, Agent, or Firm* — IP Law Leaders, PLLC

(57) ABSTRACT

A control arrangement for overriding automated control of sets of traffic lights at a string of intersections. The control arrangement comprises a control unit and a plurality of base units. The control unit comprises electrical circuitry disposed to generate at least one command signal and to wirelessly transmit the at least one command signal comprising traffic light control instructions to the base units. The control unit electrical circuitry comprises a control unit processor. Each of the base units include an electrical circuitry comprising a base unit processor and a receiver, the receiver being disposed to receive the at least one command signal from the control unit, and pass the command single onto other base units, wherein the circuitry comprises a hard wire connection disposed to connect to the mechanical connector of an automated traffic light controller.

18 Claims, 13 Drawing Sheets

| TABLE 1 | |
|---|---|
| Part # | Description |
| A | Main Roadway |
| B | Side Roadway 1 |
| C | Side Roadway 2 |
| D | Side Roadway 3 |
| E | Traffic Light 1 |
| F | Traffic Light 2 |
| G | Traffic Light 3 |
| H | Traffic Light Controller 1 |
| I | Traffic Light Controller 2 |
| J | Traffic Light Controller 3 |
| K | Police Officer |
| 100 | Control Arrangement |
| 120 | Control Unit |
| 140 | Command Signal |
| 144 | Daisy Chain |
| 150 | Modified Command Signal |
| 160 | Base unit |
| 180 | Control Unit Antenna |
| 190 | Base Unit Antenna |
| 200 | Cable Connection |
| 201 | Traffic Light Controller Housing |
| 207 | Traffic Light Controller |
| 220 | Circuitry |
| 240 | Control Buttons |
| 260 | Screen |
| 280 | Transmitter |
| 320 | Battery |
| 340 | Battery Recharger |
| 360 | Battery Condition Indicator |
| 380 | Receiver |
| 400 | Color Changing LED Indicator Lamps |

*FIG. 10A*

| TABLE 1 (continued) | |
|---|---|
| Part # | Description |
| 420 | Speaker / Buzzer |
| 440 | Vibrator |
| 460 | Logic Center / CPU |
| 480 | Battery |
| 500 | External Power Supply |
| 520 | Circuitry |
| 560 | Connector |
| 580 | Radio Frequency Receiver |
| 600 | Transmitter |
| 620 | Connect / Disconnect Relay |
| 640 | Light Advance Relay |
| 660 | Antenna Connection |
| 680 | Waypoint Indicators 1-4 |
| 700 | Connector to Terminals or Line Voltage Indicator |

FIG. 10B

WIRELESS TRAFFIC LIGHTS SYNCHRONIZER

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates to a control arrangement for controlling multiple traffic light controllers for simultaneous control of traffic lights at more than one traffic intersection.

BACKGROUND OF THE INVENTION

Traffic lights are typically automatically controlled under repeating timing cycles for each light. Municipal authorities usually determine ordinary, predictable traffic volume, and adjust light length cycles accordingly. It is often necessary for police officers and other municipal authorities to override and modify automated traffic light control sequences. A temporary activity which changes the usual traffic patterns is typically a cause for such necessity. Rush hour traffic, a sports or theatrical event at a church or school or displacement of traffic from other roads are some examples of temporary activities which could cause delays and backups at a particular intersection and/or roadway which is controlled by traffic light(s) which are under automatic control.

If an automated traffic light controller is to be modified an Officer must be located proximate the traffic light controller or control box, which is typically located proximate the roadway or intersection being controlled. Manufacturers of traffic lights and their controllers have anticipated this need, and have provided a plug-in connection in the control box for entering commands which override the automated sequences. Commands may be entered by a hand held control unit which may be a pushbutton controller or other manually operated device. In such prior art arrangements the hand held controller has a cord and terminal which provides a hard wired or continuous mechanical and electrical communications line to the control box. The manually entered commands cause the controller to implement the next phase of the pre-established automated sequence. However, such commands are not remembered, so that the person entering these commands must remain with the controller and continue to enter commands as long as he or she wishes to override the automated sequences. This system requires at least one officer for each traffic light to be controlled. When controlling traffic on a long stretch of roadway, this would require many officers to coordinate efforts to move traffic smoothly.

While this current system enables manual overriding control of the traffic light, it nonetheless has adverse consequences. One is that the police officer or other personnel controlling the traffic light is located at a vantage point which is usually far from optimal in observing traffic conditions. A second adverse consequence is that multiple officers must communicate with one another to assure efficient and appropriate management of the traffic along a stretch of roadway with multiple traffic lights. This communication can be cumbersome and subject to misunderstandings. The more lights that need to be controlled, the more coordination that is necessary. This still does not address the problem of tying up multiple officers to manage traffic on a specific roadway.

Traffic light boxes, as ordinarily supplied and installed, do not have means for communicating remotely. Rather, each has a plug-in terminal for receiving the known prior art hand held controller.

Remote traffic controllers which enable management of traffic lights from a location remote from the control box are known. In the most widely recognized configuration, these systems are often configured to send all traffic phase data and information to a central location, usually an indoor monitoring and control center. These systems are very expensive and require significant upgrades to municipal infrastructure to implement, including installation of cameras, network infrastructure, and new traffic controller units within the cabinets to ensure smooth integration. This solution, while technically feasible, would impose significant and objectionable costs to the municipality operating those traffic lights.

In another configuration, Wireless Traffic Control devices are also known art. These devices are not integrated into the traffic controller cabinet, but rather are portable, and require external power source which limits their useful duration while deployed at a particular intersection. These devices also require the presence of one officer to operate each individual controller, thus requiring one officer per intersection. Additionally, while these controllers do have the ability to learn new traffic timing cycles, they do not have the ability to communicate with each other or to discern their location in the timing of the lights on the street relative to the other lights on that same street.

There remains a need for a multiple traffic light control system which reduces the demand for police personnel in temporarily overriding automated traffic light control, improves traffic control and which does not impose undue costs of extensive modification to existing traffic light controllers and infrastructure. Additionally, while this system is installed inside of the traffic controller cabinet, it does not replace or re-configure any of the existing components. In this configuration it can readily be deployed on a stretch or roadway for a set period of time in relation to a specific event such as an extended detour due to road construction, and then easily removed and re-deployed at a new location with minimal software changes.

SUMMARY

The present invention addresses the above need by providing a remotely operated controller which both allows one person to manage multiple traffic lights, and which cooperates with typical existing traffic light phase controllers currently in use by municipalities.

The novel remotely operated controller comprises two separate components, including a first component which is maintained by the person managing the traffic light, and a plurality of second components which receive remote signals from the first component. The second components are separately installed inside traffic light enclosures and use the conventional plug-in connection terminals to transmit command signals to a conventional automated traffic light controller. This second component would be installed in each box to be controlled in a synchronous manner. These second components would communicate both with each other as well as with the first component to coordinate all lights to work together. The terms "automatic traffic light controller", "automated traffic light controller" and "traffic light controller" are hereinafter regarded as equivalent terms.

The system may utilize radio frequency signals, including but not limited to WiFi, Blue-Tooth, RF, and Infra Red. The system may encode these signals to maintain integrity of the system. The system may also incorporate a wireless mesh network system to share information from unit to unit. This wireless mesh network would allow the first component to know in real time the status of each of the second component units.

The system may incorporate an "Ingress" mode in which a desired sequence is formulated and programmed to facilitate light patterns that promote moving traffic into an area more effectively. The system may also incorporate an "Egress" mode in which a desired sequence is formulated and programmed to facilitate light patterns that promote moving traffic out of an area more effectively. The system may also incorporate a "Main all Green" mode in which the desired sequence would phase all of the lights in sequence to green in the priority direction. The system may also incorporate a "Side Streets Green" mode in which the desired sequence would phase all of the lights in sequence to green on the side streets and all to red in the priority direction. The system may also incorporate a "Smart Disconnect" feature which could be used to cease remote control of the system and return the lights to their normal automated traffic pattern. The system may also incorporate a "Standby" mode in which the remote controlling system waits a pre-determined amount of time for user input before performing a "Smart Disconnect" and reverting traffic back to normal operation.

BRIEF DESCRIPTION OF THE DRAWINGS

FIGS. 10A and 10B show a listing of parts with respect to FIGS. 1A through 5.

Similar reference characters denote corresponding features consistently throughout the attached drawings.

DETAILED DESCRIPTION OF THE PREFERRED EMBODIMENTS

Figure 1A:
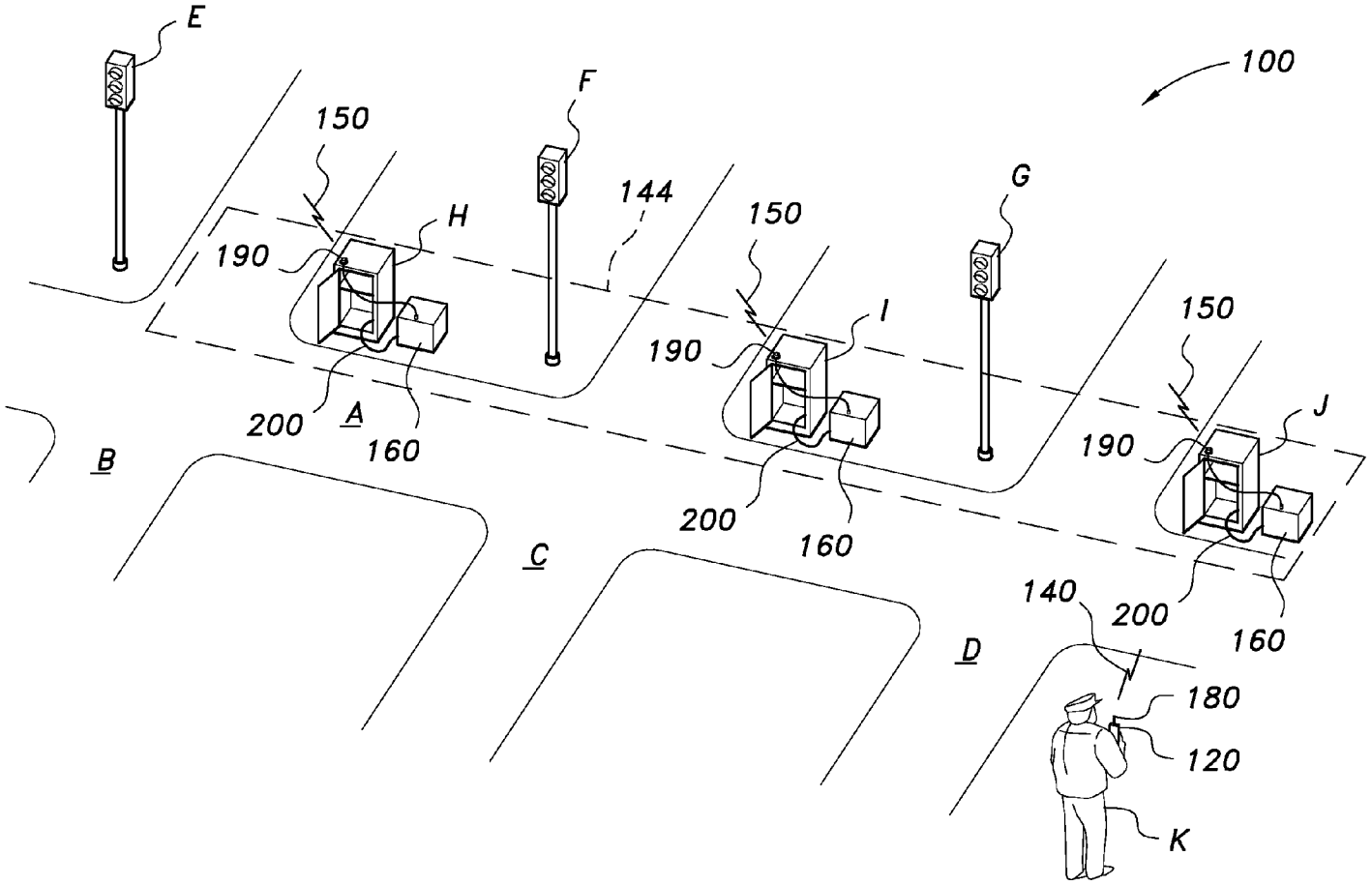
FIG. 1A is a diagrammatic environmental view of a control arrangement as it might be employed according to at least one aspect of the invention.

The present invention is directed to a control arrangement 100 for overriding the control of traffic lights which during normal operation are otherwise under the control of traffic light controllers. The traffic light controllers each include a mechanical connector for receiving hardwire command signals. More specifically, a hand held control unit 120 is configured to respond to commands imputed manually into the control unit by an operator such as a Police Officer; the manual commands are converted by the control unit 120 into wireless command signals 140 which are wirelessly communicated to at least one base unit 160 in a daisy chain 144 of base units 160. Each base unit 160 functions as a temporary controller and upon receipt of wireless command signals 140 communicate the command signals to the traffic controller via the mechanical connector of the traffic controller thereby overriding the control of a set of traffic lights otherwise slaved to the traffic light controller. It should be understood that the terms "command signals" and "control signals" are hereinafter regarded as equivalent terms. It should also be understood that the term "automated traffic controllers" and "traffic controllers" are hereinafter regarded as equivalent terms.

Figure 1B:
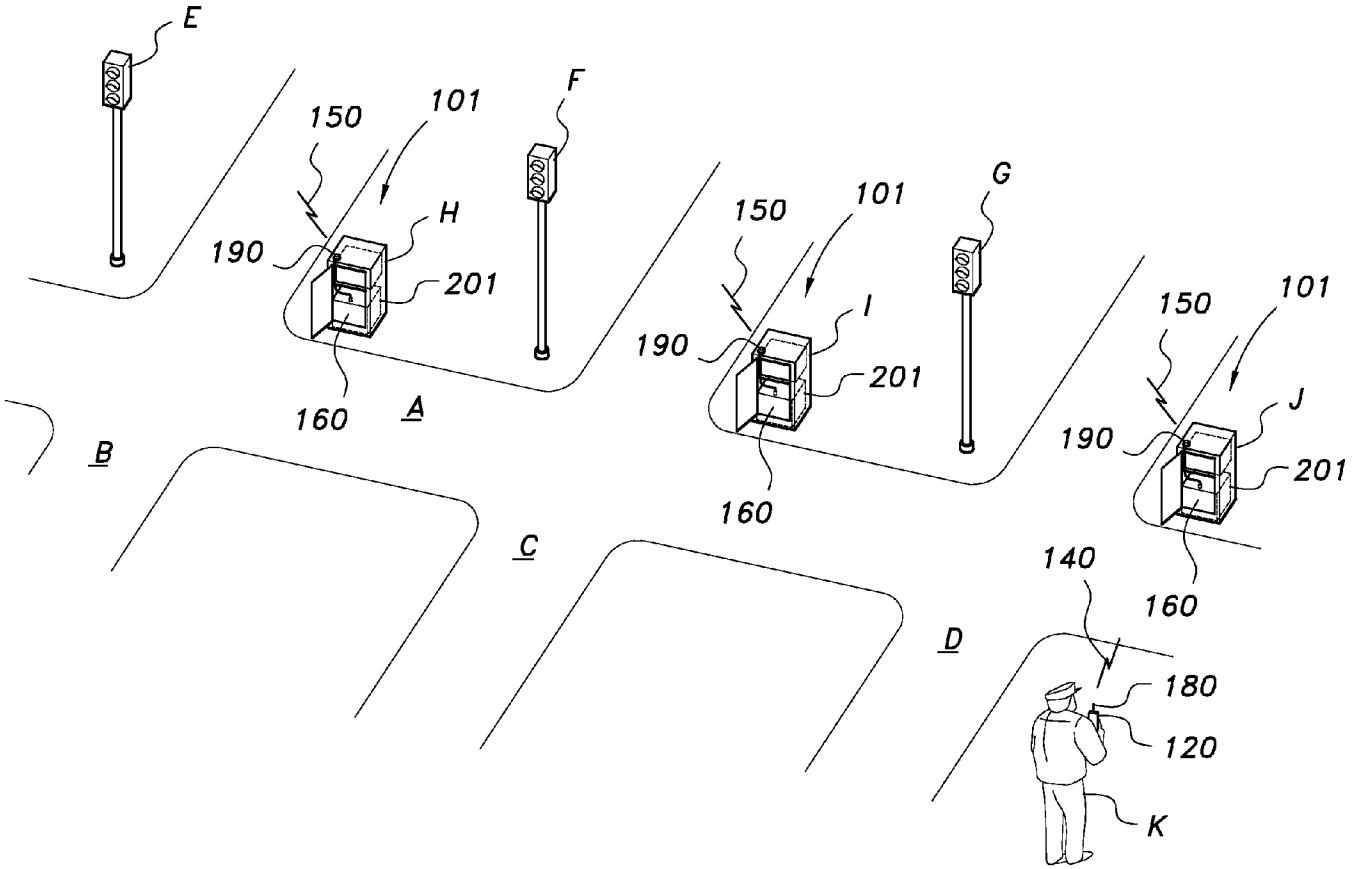
FIG. 1B is a diagrammatic environmental view of a control arrangement as it might be employed according to at least one aspect of the invention.
Figure 1C:
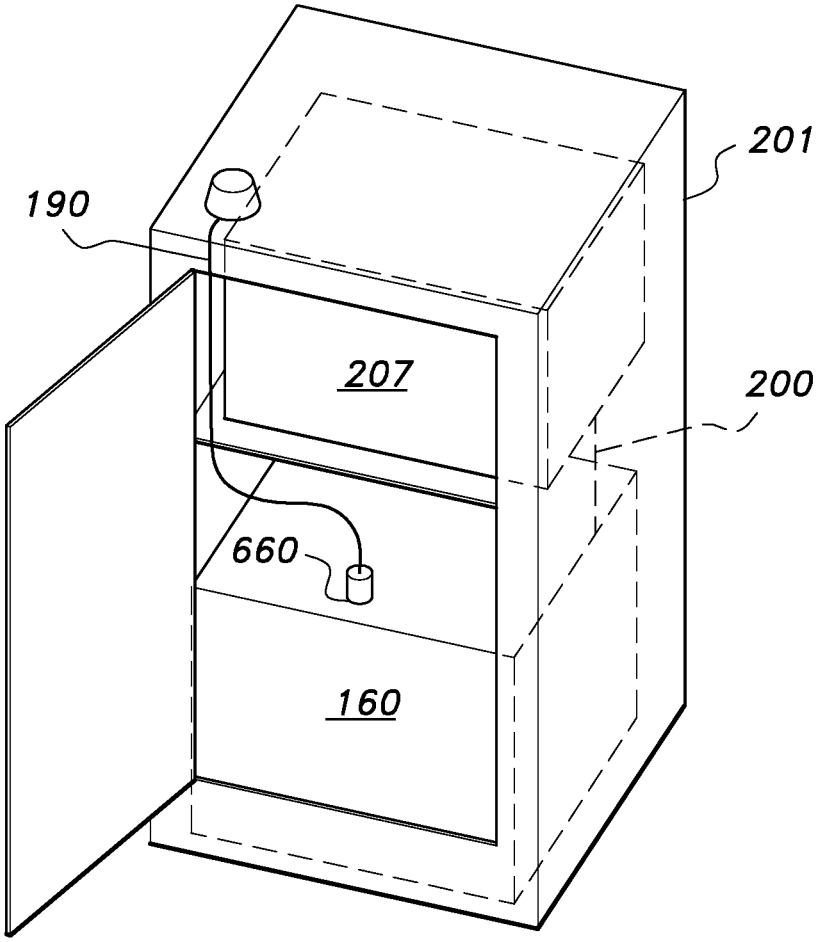
FIG. 1C shows a base station located inside the enclosure of an automated traffic controller according to at least one aspect of the invention.

In one non-limiting embodiment the present invention contemplates a wireless remote link device being installed inside of a traffic light controller housing 201 (see FIGS. 1B and 1C) and attached to traffic light controller (represented symbolically by the numeric label "207" in FIG. 1C). This device, hereby referred to as a base unit 160, may interface with a traffic controller component 207 via an over-ride interface which may be located in the base unit 160. The base unit 160 can be connected to the traffic controller via a splice, stab on terminal, or other connection type disposed to connect one wire to another wire or terminal. Each base unit could be installed proximate to or actually inside a traffic control housing 201 (see FIGS. 1B and 1C); the terms "housing" and "enclosure are hereinafter regarded as equivalent terms. Once activated, the base units would interface with the traffic controller via the over-ride interface. Once activated, the base units would also interface with each other via wireless signals. When configured in such a manner, the handheld control unit would be used to send control commands to the base units, and would receive system status updates from the base units. In such a configuration, one authorized officer, such as a Police Officer, could control traffic on an entire street, roadway or pre-determined route from one Handheld Controller.

Referring first to FIG. 1, there is shown an intersection of four roadways A, B, C and D, which intersection is controlled by traffic lights E, F and G. Ordinarily, the traffic lights E, F and G are under automated, fixed, repeating cycling control of traffic light controllers H, I and J, which are housed in a weather resistant housing located remotely from the traffic lights E, F and G. The traffic light controllers H, I and J, have circuitry which establishes timing cycles of the various directional control lights (such green, yellow and red lights, etc) of traffic lights E, F and G.

In the event that temporary traffic conditions render the usual time cycling of the lights E, F and G inappropriate, a representative of the municipal authority which operates the traffic lights E, F and G, such as a police officer (K), may take modified operation of the traffic lights E, F and G using a control arrangement 100 in the following way.

The police officer K, who is charged with assuming control of traffic lights E, F and G may maintain in his possession and control a handheld control unit 120 which comprises electrical circuitry 213 disposed to generate control commands which supersede those which have been preprogrammed or otherwise installed in the traffic light controllers H, I and J. The electrical circuitry 213 of the control unit 120 may be provided with the ability to generate control commands and to transmit these control commands via transmitter 280. Illustratively, the control unit 120 may incorporate a radio frequency transmitter (represented by an antenna 180, with command signals being indicated symbolically as 140). Base stations 160 may each comprise an antenna 190, which can be plugged into an external antenna connection 660 (shown in FIG. 3), for receiving command signals 140 and transmitting wireless signals 150 such as, but not limited to, confirmation signals to confirm receipt of command signals 140 from the control unit 120.

Figure 2:
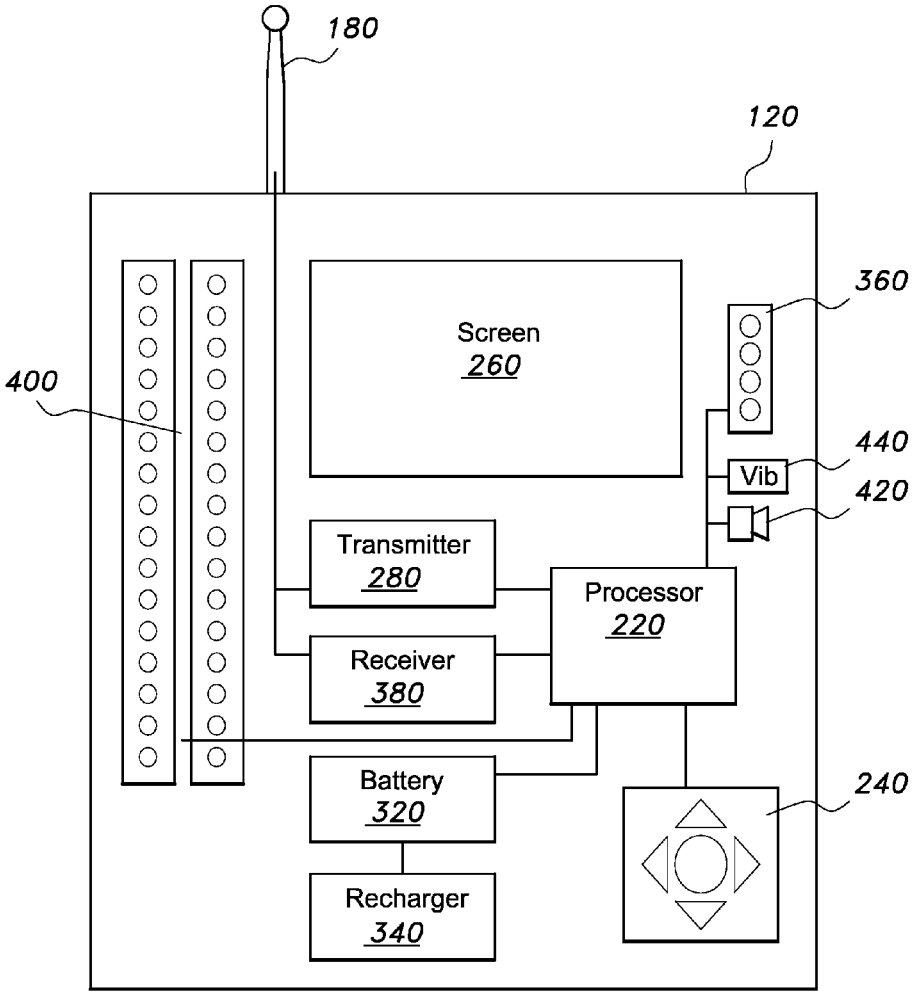
FIG. 2 is a diagrammatic representation of functional components of a portable control unit shown at the bottom of FIGS. 1 and 2 (labeled as #120).

In FIG. 2 the electrical circuitry 213 of the control unit 120 is shown, and comprises a processor 220, a display screen 260, a transmitter 280, a receiver 380, a battery 320, a battery recharger 340, a battery condition indicator 360, an annunciator lamp 400, an audible annunciator represented by a buzzer 420, and an annunciator vibrator 440.

The control unit 120 cooperates with a plurality of stationary base units 160. It should be understood that the base units 160 are stationary during normal use, but are otherwise carried by a person for attachment to a traffic light controller. Each of the base units 160 include an electrical circuitry (see FIG. 3, not shown in its entirety) comprising a radio frequency receiver (shown symbolically as an antenna 180 in FIG. 1) for receiving the command signals 140. The stationary base unit 160 transfers the commands 140 to other base units 160 on the street via antenna 180. The individual base units 160 then transmit the commands to their attached traffic light controllers H, I or J by a hard wired connection comprising and represented by a cable 200. The cable 200 mechanically plugs into or otherwise connects to, and is compatible with the existing police over-ride interface wiring for the pre-existing mechanical connector or port (not shown) which is conventionally furnished as part of the traffic light controllers H, I and J, and which is conventionally used to enter manual command signal to override the sequences established by the traffic light controllers H, I and J. Whereas the conventional overriding manual signals can only be generated by an officer located near the respective traffic light controllers H, I or J, and each manual signal must be followed by a subsequent manual signals to continue to manipulate the traffic lights. The novel arrangement 100 both enables remote generation of command signals, and further would also enable multiple traffic lights to be sequenced and controlled by one officer from one location on the street, roadway or route.

FIG. 2 shows an exemplary mobile control unit 120. The control unit 120 is mobile in the sense that it can be carried about as the operator, e.g., police officer K, moves to different locations along street A, which is under overriding control. By contrast, the base units 160 remain connected to their respective traffic controllers H, I and J via cable connection 200 (see FIG. 1A).

The control unit 120 may comprise circuitry, which may take any of several forms. It may for example comprise electromechanical relays and be essentially hard wired. Alternatively, it may comprise electronic data processing apparatus. Of course, it may comprise a combination of these elements. The circuitry comprises all components necessary for operation as described herein, such as conductors, connection logic, relays, switches, etc. This will apply to circuitry in the base unit 160 as well.

Regardless of its exact implementation, the processor circuitry 220 is adapted to receive inputs and to generate appropriate outputs. One input is signals generated when the police officer K depresses one of the control buttons 240. The processor circuitry 220 transmits a signal to the base unit 160 in response to manual inputs from an Officer (such as a Police Officer), using a transmitter 280 and the antenna 180. If the signal is an overriding control signal 140 the signal may be transmitted by the receiving base unit 160 to other base units operationally attached to the traffic controller H, I or J (see FIG. 1). This signal may be further modified and re-transmitted as a modified command signal 150 by one base unit to the next in a daisy chain 144 down the length of the street (see FIG. 1A). Should the daisy chain 144 be broken for example because a signal 190 can't be received due to a parked truck from the other base stations then the operator (such as a Police Officer) of the control unit 120 can walk to a different position to directly communicate with the base stations unable to receive transmission traffic from other base stations.

Each command signal 140 may cause the base units 160 to execute various pre-determined programs. These programmed responses would instruct each base unit 160 to cause the traffic controller to advance to the next traffic light function in a specified sequence. The control unit 120 may further comprise a power source such as a battery 320, a battery charger 340 which may incorporate a fast charge feature and other contemporary technology to result in effective, non-destructive charging, such as eliminating or minimizing overcharging for example, and a battery condition indicator 360 which may for example display voltage level or other electrical characteristics of the battery 320. Although depicted as showing a series of individual lamps which may for example be progressively illuminated to indicate state of charge, the battery condition indicator 360 may take any suitable form.

It may be noted here that the control unit 120 may have signal receiving capability, such as by incorporating a radio frequency receiver 380 which is connected to the antenna 180. One possible use of the receiver 380 is to receive status signals confirming receipt of command signals by the base unit 160 from the control unit 120. Receipt of confirmation signals may be signaled in any suitable way, such as by operating an annunciator lamp 400 for generating a visible signal, an audible annunciator such as a buzzer 420 for generating an audible signal, or an annunciator vibrator 440 for generating a tactile or vibrating signal. Another possible use of the receiver 380 is to receive signals confirming the status of each of the base units 160. Such status information may be interpreted and displayed on the control unit 120 using an array of LED's, bi-color or tricolor LED's (shown figuratively as 400) to indicate the status of each stationary base unit 160, as well as the status of the traffic lights E, F and G at the corresponding intersections B, C and D. This status information may also be interpreted and displayed in any suitable format on screen 260. This status information may also be conveyed in a computer interface or any other suitable arrangement for accomplishing the performance described herein.

Figure 3:
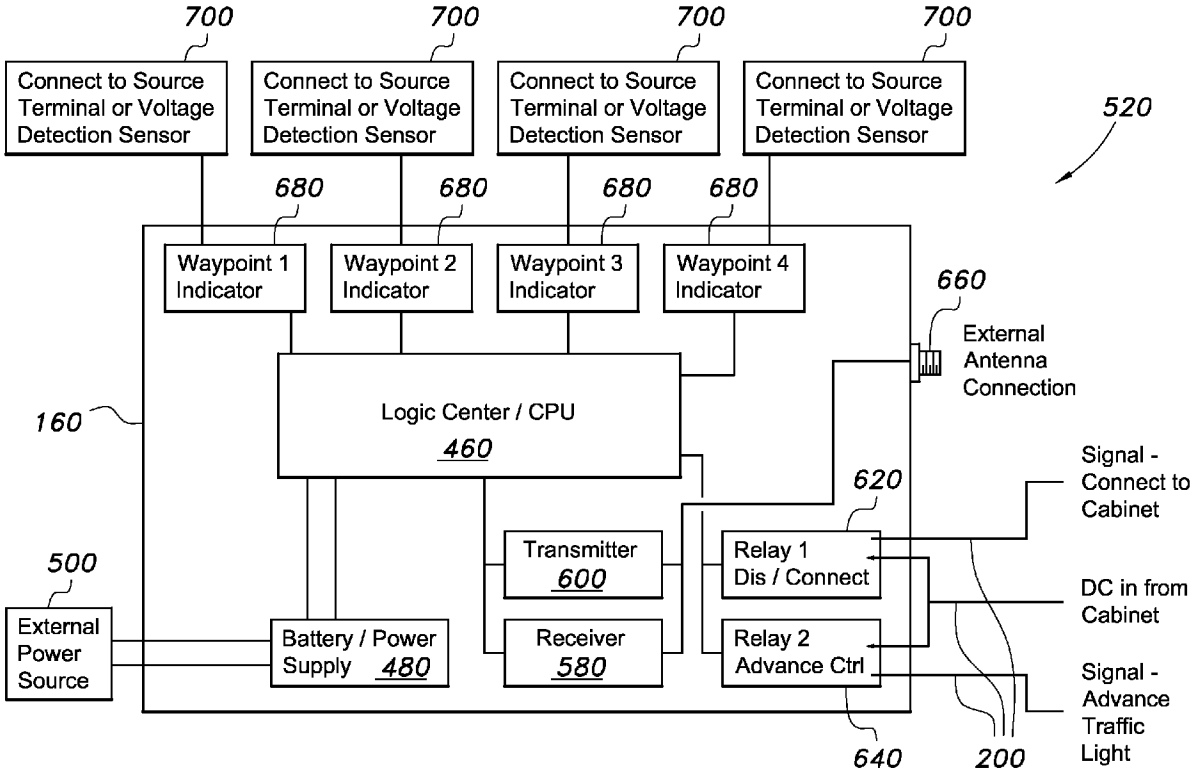
FIG. 3 is a diagrammatic representation of functional components of a base unit shown at the upper right of FIG. 1 (labeled as #160).

Turning now to FIG. 3, the base unit 160 is seen to comprise a base unit processor 460; the base unit processor 460 is typically a processor such as a CPU (central processing unit). In one embodiment the base unit processor 460 is a CPU upon which algorithms are run to ensure efficient communication between the base units 160 that make up the daisy chain of base units 160. The base unit processor 460 could utilize hard wiring such as that incorporating electromechanical relays in whole or in part if desired. The base unit 160 may utilize one or more antenna's, to include internal and or external antenna setups.

The base unit 160 may comprise a battery 480 which can be a rechargeable battery, and an optional external battery charger 500, all of which may be similar to their correspondingly named counterparts of the control unit 120.

The various electrical components of the base unit 160 described above are interconnected by electrical circuitry 520. The electrical circuitry further comprises a hard wired connection 200 (shown in FIG. 5) disposed to communicate command signals received from the control unit 120 to a traffic light controller such as traffic light controller J (see FIG. 1A). The hard wired connection 200 may comprise a connector 560 (see FIG. 5) which is dimensioned, configured, and otherwise disposed to mechanically connect to the pre-existing mechanical connectors (not shown) of the traffic light controllers H, I and J. The connector 560 provides a secure connection to a traffic light controller but can also be detached from a traffic light controller; in this context the connector 560 can be considered to be a removable or detachable connector. Usually, mechanical connection comprises attaching the connector 560 to terminals (not shown) located within the traffic light controllers H, I and J enclosures (represented by housing 201 in FIG. 1C). The connector 560 may terminate the cable 220, which may comprise any suitable form.

The electrical circuitry 520 may comprise a base unit processor 460, a transmitter 600, a receiver 580, two or more relays (620-640), multiple waypoint indicators 680, voltage detection sensors 700, and an external antenna attachment 660. The base unit processor 460 is programmed to selectively operate in any one of the below described modes.

The base units 160 are pre-programmed and installed inside of the traffic controllers H, I and J. The base units 160 may receive power from within the enclosure itself, and may remain on in standby mode until, for example, the base units 160 receive a command signal 140.

Base units 160 set to standby mode actively listening for an activation signal from the control unit 120. This signal could be in any suitable form for the wireless transmission of data including but not limited to RF, Blue Tooth, Wi-Fi, Infrared, etc. Unless a valid command is received from control unit 120, the system will assert no control over the traffic controllers H, I and J. If the base units 160 receive a valid command signal from controller unit 120, then base units 160 will become active and begin monitoring the waypoint indicators 680. When each base unit 160 reaches its respective waypoint 1 marker in the light sequence, the base unit would then activate relay 1 (620) to assume control of its respective traffic controller H, I or J and relay such information to the control unit 120. Once all of the base units have reached their respective waypoint 1 designations and have assumed control of their respective traffic controllers as described above, control unit 120 will then be enabled to execute additional commands. All commands will be designated by control unit 120. These commands or programs can include but are not limited to Main All Green, Side All Green, Ingress Sequence, Egress Sequence, etc. The control logic for performing the Ingress Mode, Egress Mode and the Side All Green is stored on the base units' processors 460 and these modes are activated in response to instructions received from the control unit 120 in the form of at least one command signal.

Main All Green mode would consist of the base units 160 all being instructed to advance their corresponding traffic lights (E, F or G) sequence to indicate green lights in along the main street (symbolically labeled "A" in FIG. 1). Once the respective base units 160 reach their respective designated locations to indicate green on main street A, their respective waypoint indicators 680 would indicate such to their base unit processors 460, which would then hold their sequences and relay this status information to control unit 120 and await further instructions. A second waypoint indicator 680 could be used to indicate other directional indicators, such as turning arrows and pedestrian crossings, that would need to be ceased prior to holding and waiting for further instructions from control unit 120.

Sides All Green mode would require instructions (command signals) to be communicated to the base units 160 to advance their corresponding traffic lights (represented symbolically by E, F and G in FIG. 1) sequence to indicate green lights in the direction of the cross streets, in this case B, C and D. Once the respective base units 160 reach their respective designated locations to indicate green on the side streets B, C and D, their respective waypoint indicators 680 would indicate such to their base unit processors 460, which would then hold their sequences and relay this status information to control unit 120 and await further instructions. A second waypoint indicator 680 could be used to indicate other directional indicators, such as turning arrows and pedestrian crossings, that would need to be ceased prior to holding and waiting for further instructions from control unit 120.

Ingress mode would require base units 160 all being instructed to advance their corresponding traffic lights (E, F or G) in a pre-programmed sequential manner to facilitate green lights on main street A or another designated route for bringing increased volumes of vehicle traffic into a specific area. This pre-programmed sequence would cause the traffic lights H, I and J to cascade in a fashion that would facilitate ushering traffic into the designated area in a more expeditious manner. This would be achieved by the respective base units 160(H), 160(I) and 160(J) reaching their respective designated locations to indicate green on street A or the designated route in a specific timed sequence using delays. This would occur in a manner consistent with those already described herein.

Egress mode would work the same as Ingress mode, but would be timed in such a way as to facilitate green lights on main street A or another designated route for extricating increased volumes of vehicle traffic out a specific area.

Smart Disconnect Feature

Figure 6:
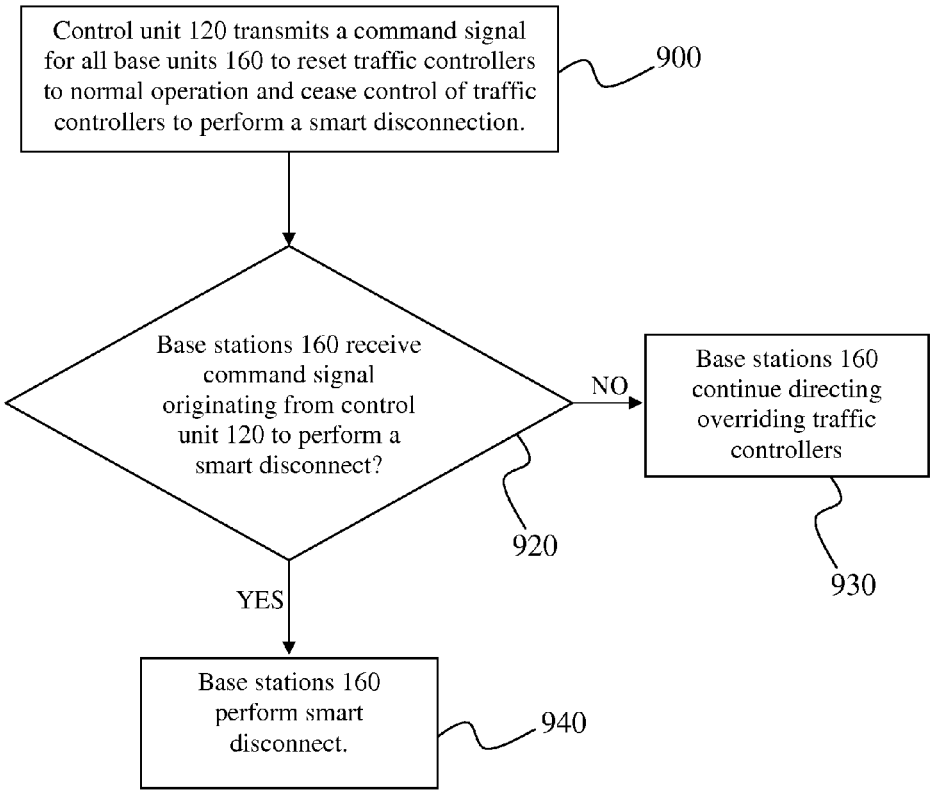
FIG. 6 shows a flow chart according to at least one aspect of the present invention.

In this mode the control unit 120 communicates a command signal to the base units 160 to reset the traffic light controllers by to return the traffic lights to their normal automated traffic pattern. This smart disconnect feature, which may take the form of a smart disconnect algorithm stored on processors 220 and 460, allows the control unit 120 to command the base units 160 to simultaneously return the traffic lights to their normal operation without requiring Officers to manually unplug the base units 160 from the traffic light controllers, i.e. there is no requirement to break a hardwire connection between base units and traffic light controllers. The smart disconnect feature can be implemented in software code on the control unit's processor 220 with responsive software code implemented on each base unit's processor 460. If all the base units 160 are able to receive wireless command signals 140 from the control unit 120 then the base units 160 can be instructed directly to perform a smart disconnect as shown in FIG. 6. In the alternative, command signals to perform a smart disconnect could also be received by the base units 160 either directly from the control unit 120 or indirectly via a daisy chain 144 made up of base units 160 (see FIG. 7).

FIG. 6 shows an exemplar smart disconnect algorithm. At 900 control unit 120 transmits a command signal to all base units 160 to reset traffic controllers to normal operation and cease control of traffic controllers by performing a smart disconnection. At 920 the base stations 160 receive a command signal originating from control unit 120 to perform a smart disconnect. At 940 the base stations 160 perform smart disconnect. However, if the command signal to perform smart disconnect is not received by some of the base stations 160 then those base stations continue at 930 to override the traffic controllers based in accordance with the most previous received command signal.

Figure 7:
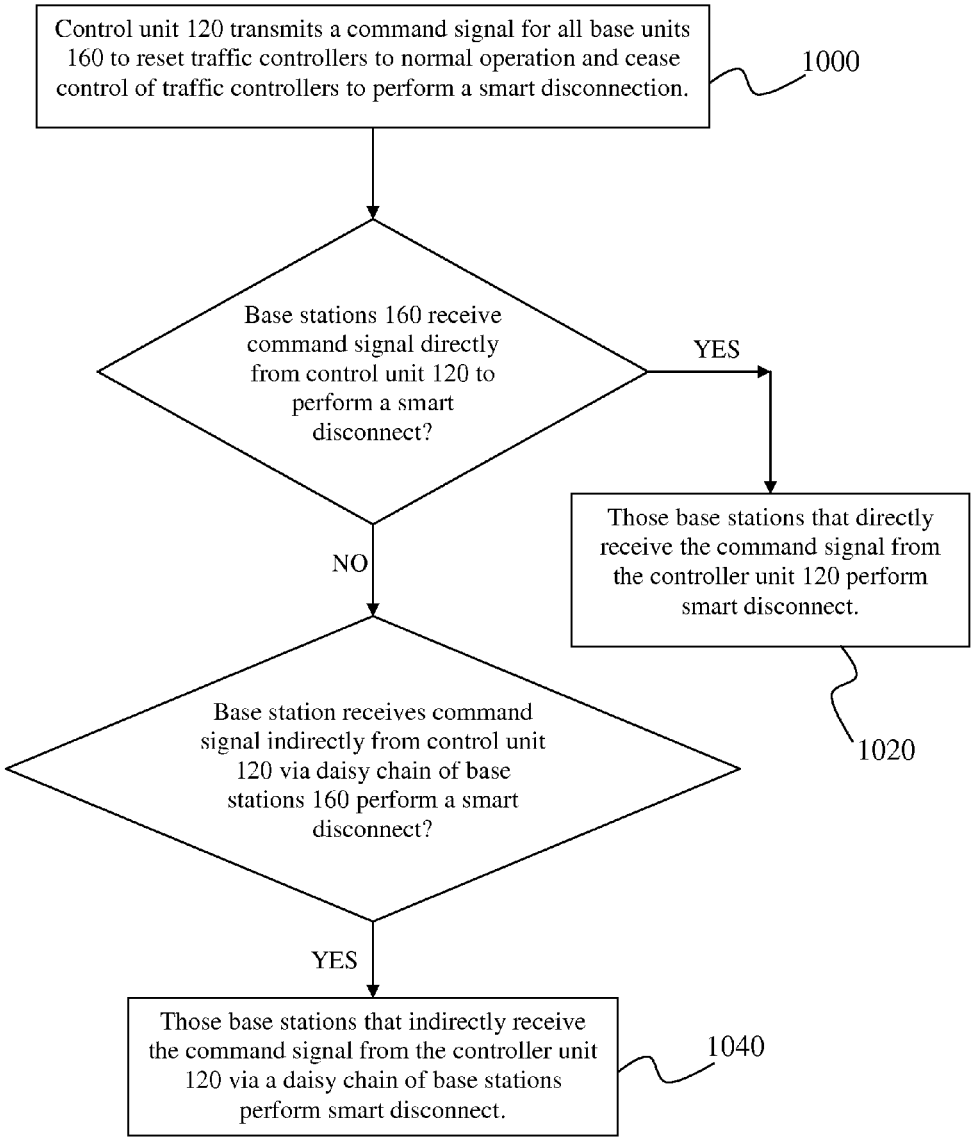
FIG. 7 shows a flow chart according to at least one aspect of the present invention.

FIG. 7 shows a non-limiting example of the smart disconnect algorithm stored on processors 220 and 460 of the control unit 120 and base units 160, respectively. More specifically, at 1000 the flow control unit 120 transmits a command signal for all base units 160 to reset traffic controllers to normal operation and cease control of traffic controllers to perform a smart disconnection. Some base units 160 receive the command signal directly from control unit 120 to perform a smart disconnect at 1020. Alternatively, some base units receive command signal indirectly from control unit 120 via daisy chain of base units 160 perform a smart disconnect at 1040. Upon receipt of the command signal to perform a smart disconnect each receiving base unit performs the smart disconnect. It is possible that a base unit receives the command signal to perform a smart disconnect from one or more other base units that form a daisy chain of base units or directly from the control unit 120 in which case the base units receiving command signals directly and indirectly from the control unit 120 perform the smart disconnect on receipt of either command signal but once the base unit has performed a smart disconnect there is no action performed on receipt of further commands to do the same thing since the smart disconnect has already been performed.

Smart Disconnect Feature Combined with Standby Mode

The smart disconnect feature can be combined with a standby mode in which base units 160 are each allocated a standby mode time period which if exceeded without receiving a command signal 140 activate the smart disconnect feature described above. More specifically, when the standby mode time period expires without receiving a command signal 140 the base unit processor 460 executes a smart disconnect from the attached automated traffic light controller after a predetermined amount of time has passed without receipt of any new command signals 140 originating from the control unit 120. For example, the standby mode time period can be set to any suitable predetermined time period which can be communicated wirelessly to the base units 160 by the control unit 120. The predetermined time period can be any time period selected by a Police Officer or other authorized person and inputted manually into the control unit 120. For example, a Police Officer may select a time period in the range 1 minute to 500 minutes; more preferably in the range 10 minutes to 100 minutes. For example, a Police Officer might select 30 minutes in which case each base unit 160 not in receipt of a command signal for more than 30 minutes performs a smart disconnect thereby causing the traffic controllers to return to normal operating mode without requiring physical disconnection of the base units 160 from the traffic controllers.

Figure 8:
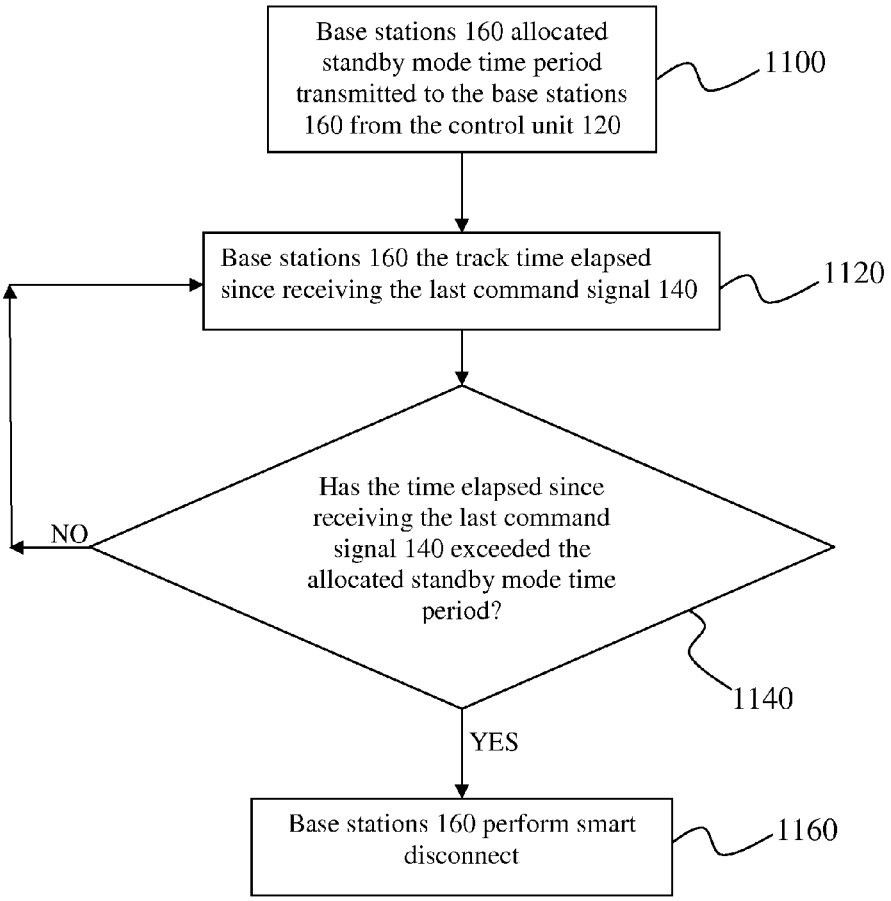
FIG. 8 shows a flow chart according to at least one aspect of the present invention.

FIG. 8 shows the smart disconnect feature combined with a standby mode. At 1100 base stations 160 are allocated standby mode time period as transmitted to the base stations 160 from the control unit 120 (based on an instruction entered into the control unit 120 by, for example, a Police Officer). At 1120 base stations 160 track the time elapsed since receipt of the last command signal 140 originating from the control unit 140. At 1140 a check is made to verify if the time elapsed since the last received command signal 140 exceeds the allocated standby mode time period. If so, the base stations 160 perform a smart disconnect at 1160 otherwise at 1120 the base stations 160 continue to track the time elapsed since receiving the last command signal 140.

Figure 9:
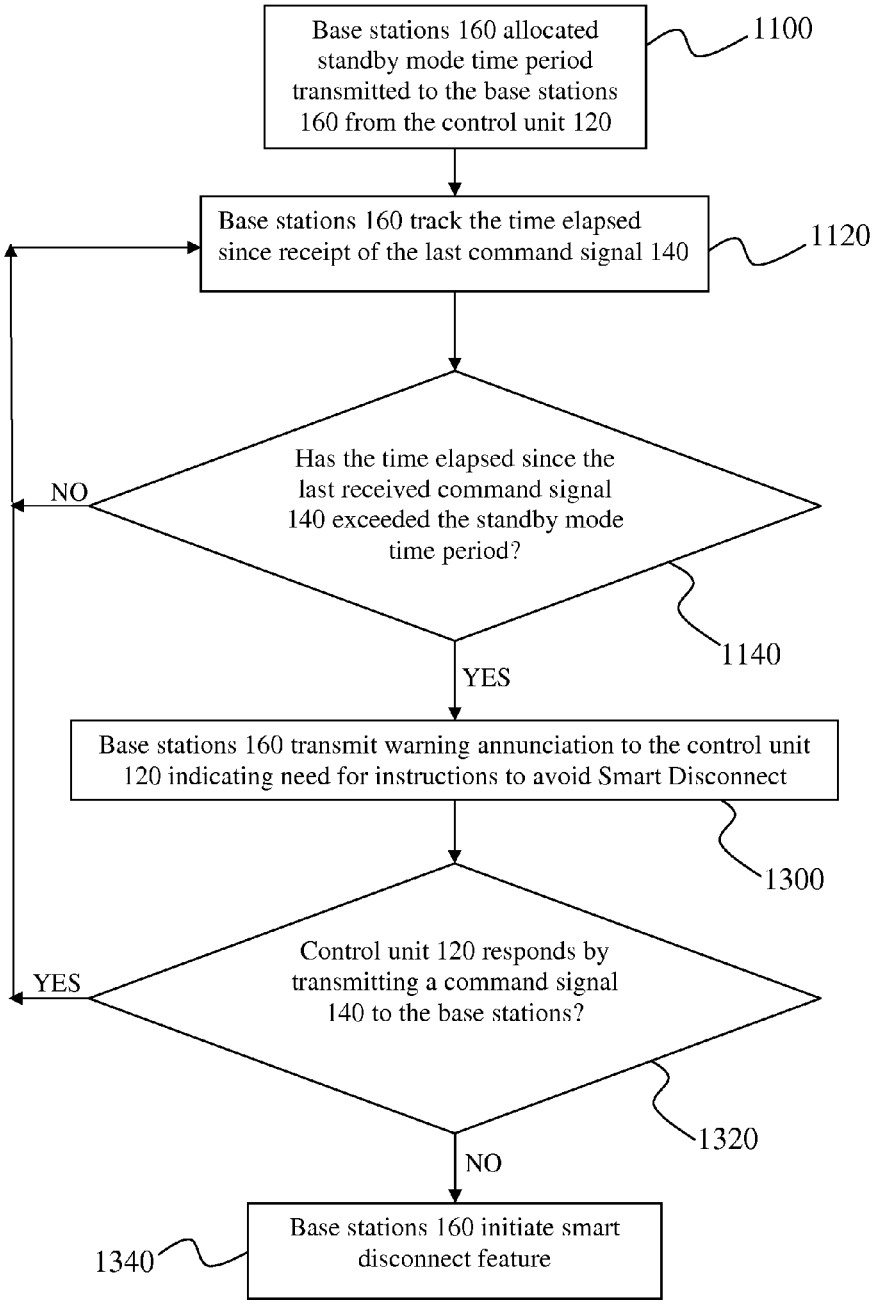
FIG. 9 shows a flow chart according to at least one aspect of the present invention.

FIG. 9 shows a further non-limiting example of the smart disconnect feature combined with the standby mode feature further comprising a warning annunciation feature. In this example, at 1300 the base units 160 transmit a warning annunciation to the control unit 120 indicating need for instructions to avoid the base units 160 initiating an automatic smart disconnect. At 1320 the control unit 120 either responds or does not respond to the warning annunciation. If there is no response by the control unit 120 then a smart disconnect is initiated at 1340. If the control unit 120 responds by transmitting a command signal 140 then at 1120 the base units 160 again track time elapsed since receipt of the last command signal 140.

In all of the embodiments described, any command signals 140 transmitted by control unit 120 to the various base units 160 would be received by the first base unit 160 in the chain, for example the base unit 160 connected to traffic light controller H. This base unit 160(H) would extract the respective data from the command signal 140. This Base Unit 160(H) would then interpret and modify the data to indicate its status, or more specifically any changes to the same. Once this data has been updated, base unit 160(H) replaces the data into the command signal 120 and then transmits it to base unit 160(I). Base unit 160(I) then repeats the above modification and transmits its modified command signal 140 to base unit 160 (J). This pattern would continue in a daisy chain fashion down the line until the last base unit in the chain, 160(J) in this example, receives the command signal 120, modifies it and then sends it back down the chain the opposite direction to 160(I) and then 160(H). As shown, 160(H) would then relay the command signal 140 to control unit 120 and then start the process back up the chain (H to I to J). This loop would repeat until all base units 160 reach their designated status as instructed by control unit 120 or until a new command is received from control unit 120.

The control unit processor 220 may be any known microprocessor integrated circuit including a process unit and memory. The memory may include random access memory (RAM), read only memory (ROM), erasable programmable ROM (EPROM) and a data storage memory, alone or in combination.

Any suitable signal methodology can be used to ensure efficient wireless communication between the base units 160, which collectively act like a daisy chain of communication nodes, and control unit 120. For example, an algorithm in the form of executable machine code stored on the control unit processor 220 of control unit 120 can attach a signal identifier to each command signal 140, and each time the control unit 120 transmits a command signal 140 the signal identifier changes. For example, the signal identifier can have a numeric value (e.g., starting at 1, which can be represented symbolically by 140(1)) which increments to a higher numeric value (e.g., 1 then 2 then 3 . . . ) thereby differentiating each command signal 140.

For example, each base unit 160 upon receiving a command signal 140(1) responds by retransmitting the command signal 140(1) to any base unit 160 in a daisy chain which is within range to receive command signal 140(1), the receiving base units 160 also re-transmits command signal 140(1) acting like repeaters or range extenders but if a base unit 160 has already received and acted on command signal 140(1), hence making it a repeat or redundant signal, then the command signal 140(1) is ignored, but the base units remain responsive to processing further command signals 140($n$+1) providing they are not repeat signals. In this manner the daisy chain processes command signals 140 in an efficient manner by quenching duplicate (i.e., redundant) command signals.

As noted previously, one possible use of the receiver 380 is to receive status signals confirming receipt of command signals by the base unit 160 from the control unit 120. Receipt of confirmation signals may be signaled in any suitable way, such as by operating an annunciator lamp 400 for generating a visible signal, an audible annunciator such as a buzzer 420 for generating an audible signal, or an annunciator vibrator 440 for generating a tactile or vibrating signal. This is fine if the control unit 120 is within wireless receiving distance of each base unit 160. To ensure each base unit 160 can communicate such confirmations to the control unit 120 each confirmation signal could incorporate a confirmation identifier which can be represented symbolically as confirm_ID(n) where n is an integer value. Confirmation signals could be either received directly by the control unit 120 from any of the base units 160 in the daisy chain 144 with the caveat that duplicate (i.e., redundant) confirmation signals are quenched to avoid runaway communication overload between the base units 160 and the control unit 120.

The methodology of quenching redundant signals is thoroughly discussed in U.S. Patent Publication Number 20060094426 published to Donaho et al; U.S. Patent Publication Number 20060094426 is incorporated herein by reference in its entirety.

The control unit 120 may comprise known apparatus for implementing an encoding feature for encoding all command signals 140 transmitted from the control unit 120, so that the command signals are secured against unauthorized modification, distortion from electromagnetic interference, and other deleterious influences.

The base units 160 may comprise known apparatus for implementing an encoding feature for encoding all command signals 140 transmitted to and from the base units 160, so that the command signals are secured against unauthorized modification, distortion from electromagnetic interference, and other deleterious influences.

Figure 4:
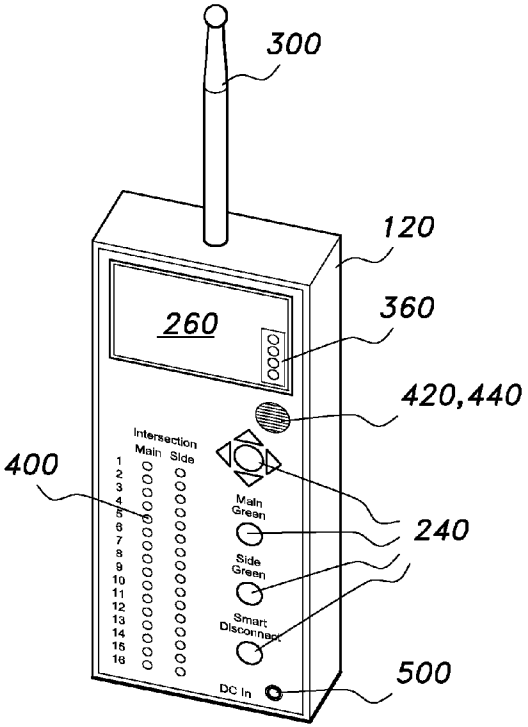
FIG. 4 is a perspective view of an implementation of the component of FIG. 2.

FIG. 4 shows one possible embodiment of control unit 120. The housing of control unit 120 may have an input power port 500 that enables an operator to charge the control unit 120. The annunciator lamps 400, the buzzer 420, the annunciator vibrator 440, the pushbuttons 240, the screen 260, and the battery condition indicator 360 may be mounted on the housing of control unit 120, which, together with its externally exposed components, may be water resistant. The antenna 180 may project through the housing of control unit 120. The screen 260 can be any type of suitable display screen such as, but not limited to, an LCD screen, an LED screen, and an LED-backlit LCD screen, alone or in combination.

Figure 5:
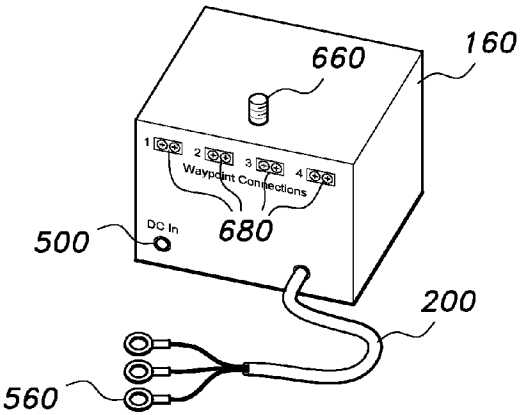
FIG. 5 is a perspective view of an implementation of the component of FIG. 3.

Referring to FIG. 5, the base unit 160 may have an input power port 500, an external antenna attachment 660, several Waypoint Indicator connection points 680 and a cable connector 200 that would be used to interface with the Traffic Light Controller's existing police over-ride interface via a removable (i.e., detachable) connection depicted symbolically as connector 560; it should be understood that in this context the term "removable" means the connector 560 can be detached from a traffic light controller. Connector 560 may take any suitable form for making a secure connection from one wire or terminal to another wire or terminal. The housing of base unit 160 and its externally exposed components may be water resistant.

The cable connection 200 may plug into a signal port located in the housing of the base unit 160. The cable connection 200 may be for example, of the type popularly used with audio/visual equipment such as stereos and like consumer electronic equipment (none shown). The cable 200 may be water resistant. The present invention is susceptible to variations and modifications which may be introduced thereto without departing from the inventive concepts.

Location of processing apparatus, software, and other supervisory capabilities, switches, and command entry interface components may be exchanged between or even redundantly furnished as part of the control unit 120 and the stationary base units 160.

Although the stationary base unit 160 has been described in terms of containing processor capability such that certain control functions are performed therein, it is contemplated that the control unit 120 could be modified to accommodate the same functions. Conversely, the control unit 120 has been described in terms of containing processor capability such that certain functions are performed therein; it is contemplated that the base unit 160 could be modified to accommodate the same functions as well.

Either or both of the control unit 120 and the stationary base units 160 may be modified for reception of signals from still other sources, such as a central control station for controlling traffic lights, such as a municipal traffic control center (not shown), and to transmit signals, such as status signals, to remote stations, such as the municipal traffic control center (not shown) which is remote from the intersection or traffic light C which is under temporary overriding control.

The control unit 120 may comprise any one or any two of the annunciator lamp 400, the buzzer 420, or the vibrator 440, rather than all three as shown and described.

Waypoint System

Figure 3A:
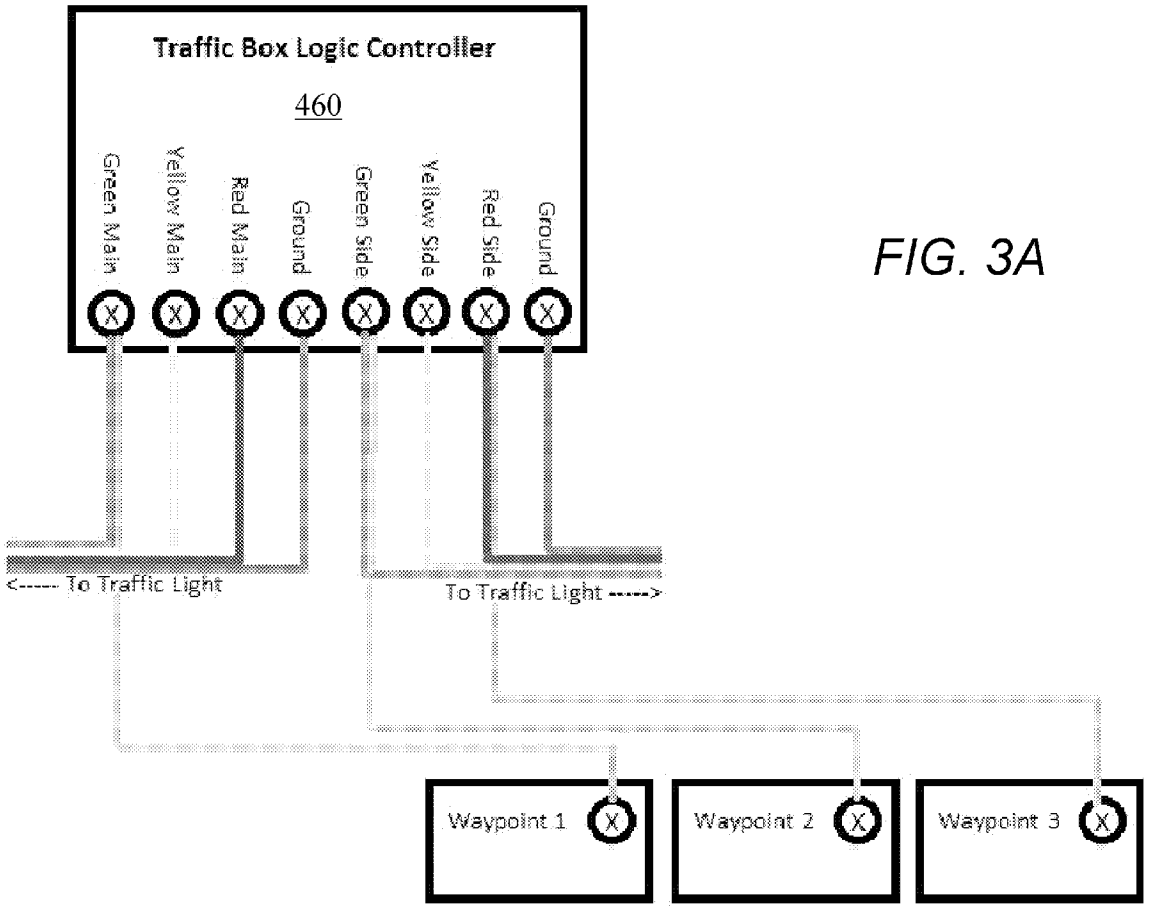
FIG. 3A shows a control unit and waypoints.

The waypoint system of the invention, also shown in FIG. 3A, is used to monitor the status of each connected light in the traffic box and serves as a check and balance indicator as well as a trouble shooting service. Upon an officer taking initial control of a roadway, each base unit is required to operate in response to the current status of the traffic control sequence. In order to become and remain synchronized with the other base units on the same street, each base unit is required to execute control over its specific traffic light at the correct time in the traffic sequence. The waypoint indicators enable an operator, for example, to impose their own timing on the traffic lights.

Example

If the intersection of Fifth and Main needs to be activated and the base unit programming calls for the base unit to assume control when the traffic lights are green on Main Street, and the turning arrow is off, the system would activate and begin to monitor the waypoints. When the waypoint connected to the main street lights cable indicates that main street cable is energized and the light is green, the system would then monitor the green turning arrow cable for that light to no longer be illuminated or energized, and the red turning arrow to cable to become activated or energized. Once the conditions of the green on main street and red steady indicator for the turning arrow are both met, the base unit can assume control of the traffic light sequence and begin execution of commands received from the control unit 120.

As the base unit 160 executes commands from either the control unit 120 or its own internal programming, it would use the waypoint indicators 680 to double check or verify that the programming and the actual traffic lights are remaining synchronized. So if for example, the base unit 160 is at a place in its cycle where it expects the lights on Main Street to be red, but the waypoint indicator for the main street green light is energized or activated, then the base unit 160 would cease activities and would indicate a fault to the control unit. Attention from an officer or other appropriately designed person would be needed to detect the problem and determine what is to be done to correct it if possible. Possible corrective action would be to execute a smart disconnect and re-boot the base unit. Absent input from the control unit for a pre-determined duration of time, the base unit would perform a smart disconnect.

Possible causes of such a condition would be a fault which throws the traffic lights into flash mode. This trigger is relatively un-controllable due to its un-predictable nature and possible triggering events such as power surges, etc. Another possible cause would be human error where another officer opens the police access door and attempts to assume control of the light with a manual cord or places the lights on flash from this control panel. This error can be avoided by providing a bypass of the front controls when the base unit is active. The front controls are activated by low voltage loops from the traffic controller that are activated or deactivated by a switch in the police panel. By installing a relay(s) that shuts the voltage off to these switches when the base unit is activated, the ability for human error is virtually eliminated. The front controls become disabled while under base unit control.

It is to be understood that the present invention is not limited to the embodiments described above, but encompasses any and all embodiments within the scope of the following claims.

What is claimed:

1. A control arrangement for overriding automated control of sets of traffic lights at a string of intersections in a specified area or street, wherein during normal operation each set of traffic lights is under the control of an automated traffic light controller, each automated traffic controller having a pre-existing mechanical connector for receiving a temporary controller, comprising:

a control unit to be operated by a person charged with assuming control of these traffic lights, said control unit comprising electrical circuitry disposed to generate at least one command signal and to wirelessly transmit said at least one command signal, said at least one command signal comprises traffic light control instructions, said electrical circuitry comprises a control unit processor; and a plurality of base units each having electrical circuitry comprising a base unit processor and a receiver, said receiver being disposed to receive said at least one command signal from said control unit, and pass the command signal onto other base units, wherein said circuitry comprises a hard wire connection disposed to connect to the mechanical connector of an automated traffic light controller and communicate said command signals to the traffic light controller via said hard wired connection.

2. The control arrangement according to claim 1, wherein each base unit comprises a waypoint indicator system.

3. The control arrangement according to claim 1, further comprising a smart disconnect algorithm stored on the control unit's processor and each base unit's processor, said smart disconnect algorithm commands said base units in response to a command signal from the control unit to simultaneously return the traffic lights to their normal operation without requiring a hard wire disconnection with respect to the mechanical connector.

4. The control arrangement according to claim 3, wherein said smart disconnect algorithm is combined with a standby mode feature in which each base unit processor executes said smart disconnect from the automated traffic light controller after a predetermined amount of time has passed without receiving a command signal originating from the control unit.

5. The control arrangement according to claim 4, further comprising a warning annunciation feature in which base unit processors include logic stored thereon that causes the base units to transmit a warning annunciation to said control unit indicating need for instructions to avoid said base units initiating an automatic smart disconnect and absent a response from the control unit in the form of a command signal said base units perform said smart disconnect.

6. The control arrangement according to claim 1, further comprising an Ingress Mode, an Egress Mode and an Side All Green Mode, wherein the control logic for performing these modes is stored on the base unit processors and said modes are activated in response to instructions received from said control unit in the form of at least one command signal.

7. The control arrangement according to claim 1, wherein said base units further comprise a data processing system which is disposed to recognize receipt of said command signals, modify said command signals with current status information, and to then forward said modified command signals to the remaining base units and the control unit.

8. The control arrangement according to claim 7, wherein said control unit comprises an annunciator disposed to generate an audible signal upon receipt of said modified command signals.

9. The control arrangement according to claim 7, wherein said control unit comprises an annunciator disposed to generate a visible signal upon receipt of said modified command signals.

10. The control arrangement according to claim 7, wherein said control unit comprises an annunciator disposed to generate a vibrating signal upon receipt of said modified command signals.

11. The control arrangement according to claim 1, wherein said control unit comprises a screen.

12. The control arrangement according to claim 1, further comprising an apparatus for implementing an encoding feature for encoding said overriding control signals, whereby said overriding control signals are secured against unauthorized modification.

13. The control arrangement according to claim 1, wherein said control unit comprises a water resistant enclosure.

14. The control arrangement according to claim 1, wherein said electrical circuitry of said control unit comprises a rechargeable battery.

15. The control arrangement according to claim 1, wherein said electrical circuitry of said base units each comprise a rechargeable battery.

16. The control arrangement according to claim 1, wherein said electrical circuitry of said control unit comprised a battery condition indicator.

17. The control arrangement according to claim 1, wherein said electrical circuitry of said control unit comprises an input power port.

18. The control arrangement according to claim 1, wherein said hard wire connection of each base unit comprises at least one manually separable cable connector having frictional engagement characteristics such that pulling on said hard wire connection when said hard wired connection is plugged into the traffic light controller will cause said hard wired connection to separate from the mechanical connector.

* * * * *